United States Patent [19]

Jewett

[11] Patent Number: 4,574,981

[45] Date of Patent: Mar. 11, 1986

[54] APPARATUS FOR DISPENSING CANS AND THE LIKE

[76] Inventor: Harold Jewett, 149 High St., Sommersworth, N.H. 03878

[21] Appl. No.: 586,317

[22] Filed: Mar. 5, 1984

[51] Int. Cl.[4] ..... B65G 59/00

[52] U.S. Cl. ..... 221/283; 221/309; 221/311

[58] Field of Search ..... 221/303–311, 221/312 R, 282, 194, 280; 312/42, 43, 45, 72; 211/59.1; 229/17 B

[56] References Cited

U.S. PATENT DOCUMENTS

| | | | |
|---|---|---|---|
| 2,360,573 | 10/1944 | Mena | 221/311 |
| 3,717,282 | 2/1973 | Nordskog | 221/279 |
| 4,042,096 | 8/1977 | Smith | 221/279 |

FOREIGN PATENT DOCUMENTS

| | | | |
|---|---|---|---|
| 258424 | 9/1926 | United Kingdom | 221/305 |

*Primary Examiner*—Joseph J. Rolla
*Assistant Examiner*—David H. Bollinger
*Attorney, Agent, or Firm*—Rines and Rines, Shapiro and Shapiro

[57] ABSTRACT

An apparatus for storing and individually dispensing cans or other similarly shaped objects. The apparatus is of tubular construction with a resilient dispensing-type outlet in the form of a slot near the lower portion of the tube to allow a can to be removed. A stop member is provided in the tube interior opposite the slot to contact the can between the center of gravity and the edge of the can to tilt the can forward in the slot.

10 Claims, 3 Drawing Figures

APPARATUS FOR DISPENSING CANS AND THE LIKE

Figure 1:
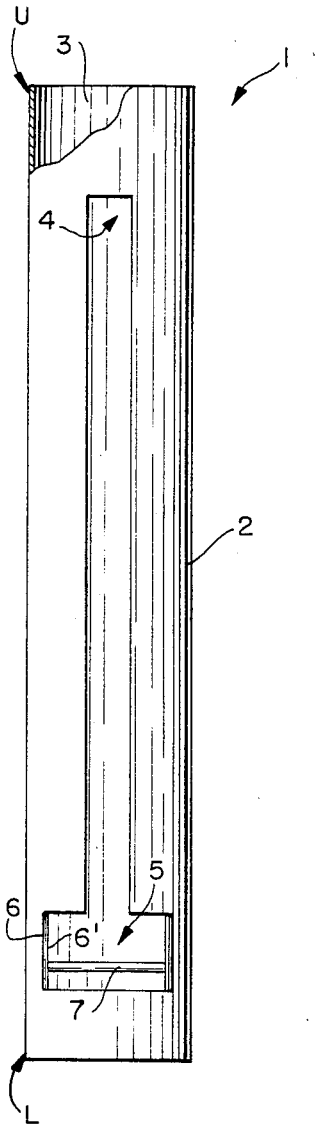

The present invention relates to an apparatus for dispensing cans and the like being more specifically directed to an apparatus for storing a plurality of similarly shaped cylindrical or other objects with means for the individual dispensing of the objects from storage.

In present day technology, numbers of similar cylindrical objects, such as circular or rectangular cross section cans, electrical fuses and the like, are normally stored in a bin, basket or shelf. The bin or basket provides relatively easy access to single objects as the random stacking arrangement produces a plethora of readily accessible protruding sections or edges. Such a system, however, requires extensive space—well above the volume of the sum of the objects—to provide the capacity to hold the objects in the random stacking arrangement. Additionally, it is difficult in a bin or basket to determine the exact number of remaining objects or the individual types of objects (for example, a variety of canned foods), without removal of the objects from storage. Finally, since objects stored in a bin or basket are held in a random stacking arrangement, removal of an individual object from the bin may cause an unexpected shifting of the stacking, producing unwanted collisions with other objects in the bin and often with the hand or other grasping means used to remove the desired object.

Although vertical co-axial stacking on a shelf relieves much of the required excessive waste of space encountered with a bin or basket, certain problems result in shelf-stacked arrangements. Objects, such as cans, stored in a shelf-stacked arrangement tend to have little or no transverse stability resulting in frequent collapse of the column of objects when any shock or force is transmitted to the column. Additionally, removal of an individual object from the column presents certain difficulties. Removal of an object from the bottom or middle of the column requires continuous support of the remainder of the column as the objects re-settle into a new shelf-stacked arrangement, else the column will collapse resulting in possible damage to the objects and to the individual attempting to remove the object. Additionally, since certain stacked objects are designed to achieve an interlocking column arrangement for more stable shelf-stacking, such as a bottom section that fits into the top section of the column-lower object, removal of an individual object from the bottom or middle of the column requires excessive transverse force to be applied or a temporary suspension of all objects in the column above the desired object. Although removal from the top of a shelf-stacked column arrangement relieves the aforementioned problems, the shelf must be situated such that easy access is constantly available to the object at the top of the column—a problem of not insignificant magnitude for storing large numbers of objects. Finally, the shelf-stacked arrangement requires the waste of storage space around the column to provide access to the sides of the desired object for transverse force to be applied for removal. However, providing sufficient space for fingers or other grasping means securely to hold the object for removal from the column removes allowance for longitudinal support members to be provided to give stability to the column, and exposes the fingers or other grasping means to possible injury from the re-settling or collapsing of the column of objects.

In accordance with the present invention, cans or the like are stored in a long storage tube of internal dimensions such as to allow easy movement with stacking confinement of the cans in the storage tube. The tube is normally secured in a vertical manner providing a vertical-axis column or stacked arrangement of horizontally resting cans. Near the bottom of the tube there is provided a re-entrant slot of vertical dimension larger than that of a can but of horizontal opening dimension just less than the can diameter to allow a can to be sprung out of the re-entrant slot from the tube in a direction at right angles to the axis of the tube, toward the user. A stop member is secured within the tube inward of the slot such that a can, under downward force due to gravity and possible additional load from above stacked cans, is internally contacted by the stop member at one or more points of the bottom wall of the can displaced horizontally from the geometrical center or the center of gravity of the can and the said vertical axis, such that the can is held tilted downward at an obtuse angle with respect to the vertical axis of the tube, extending at the forward edge portions of its upper wall outside the slot of the tube. In such a tilted state, forward side wall portions of the can frictionally and resiliently contact the juxtaposed side edges of the slot, providing a gap between the tilted can and the next above-stacked horizontally oriented can, for grasping. Sufficient force exerted on the tilted can in a direction away from the tube and toward the user will cause the can to be springingly removed from the tube through the slot, the resilient side walls of the tube slot permitting the resilient release of the can, allowing the next above-stacked can to drop into engagement with the stop member and to be tilted downwardly and forwardly in the slot for subsequent removal.

An object of the invention, therefore, is to provide a new and improved apparatus for storing and individually dispensing cans and the like that is not subject to the disadvantages of prior systems, as above explained.

Another object of the invention is to provide a novel apparatus for dispensing cans or the like in a predetermined selective order.

Other and further objects and advantages will become apparent hereinafter and are more particularly delineated in the appended claims.

In summary, from one of its broader aspects, the invention embraces apparatus for dispensing cans and the like comprising a cylindrical tube having upper and lower portions and an interior diameter somewhat greater than the diameter of the can, to allow movement of the can along the center axis of the interior of the tube; a dispensing slot near the lower portion of the tube, transverse to the center axis thereof and of sufficient dimension to allow a can to be removed from the tube through the slot; and a stop member, rigidly secured within the interior of the tube opposite the slot in the rearward region thereof such that the stop member contacts the can between its center of gravity and its rear edge when the can is moved into contact with the stop member, tilting the can forward into the slot but holding the same at the edges thereof. Preferred and best mode details are hereinafter presented.

Figure 2:
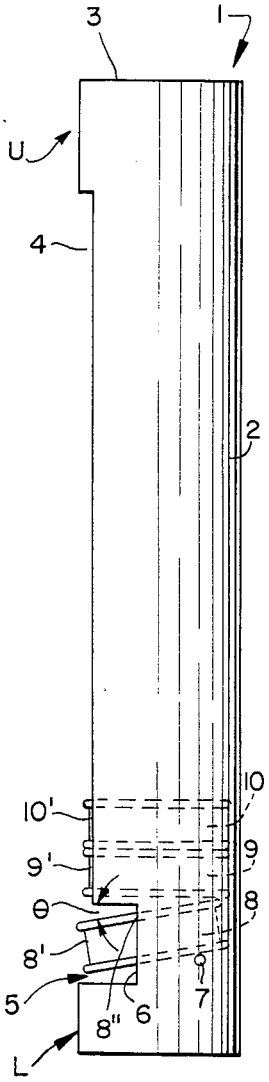
Figure 3:
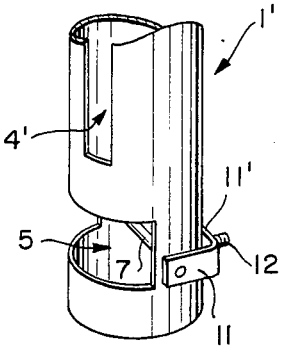

The invention will now be described with reference to the accompanying drawings, FIG. 1 of which is a front view of apparatus, constructed in accordance with a preferred embodiment;

FIG. 2 is a side view of the apparatus showing cans in storage and dispensing positions; and FIG. 3 is a fragmentary isometric of a modification.

Referring now to the figures, the numeral 1 generally represents an apparatus for dispensing cans in accordance with the invention. The apparatus 1 comprises a hollow tube 2, as of metal or plastic, having an upper portion U and a lower portion L defining longitudinally therebetween a vertical interior storage cavity 3, shown as of circular diameter or cross-section, though rectangular or other shaped cross-sections are contemplated that substantially conform to or bound the cans or other objects to be dispensed.

Extending along the length of the tube 2 in a direction essentially parallel to the central longitudinal vertical axis of the tube is a longitudinal front display slot 4. The bottom of the display slot 4 near the lower portion L of the tube 2 connects in FIGS. 1 and 2 with a transverse dispensing slot 5, shown of re-entrant form as it extends arcuately circumferentially transversely of the front lower surface of the tube, terminating at side edge portions 6 that extend parallel to the central (vertical) longitudinal axis of the tube 2. Preferably the side edge portions 6 are tapered or beveled inwardly at 6', FIG. 1, such that the length of arc of the outer portion of the slot 5 is less than the length of arc of the inner portion of the slot 5 to provide resilient can release functions later described.

A stop member, such as transversely extending rigid dowel 7, is rigidly secured between circumferentially spaced inner wall portions of the tube 2 and across the interior cavity 3 of the tube 2 in the region rearward of the dispensing slot 5. The dowel 7 preferably is secured in substantially horizontal position (or in a horizontal plane intersecting the slot 5 perpendicular to the vertical tube axis), approximately one quarter of the distance from the interior rear wall of the tube 2 into the cavity 3 opposite the slot 5, for tilting the bottom can downwardly and forwardly into the slot 5, as later described.

Referring now to FIG. 2, the numbers 8, 9 and 10 refer to cans of cylindrical cross-section held within the interior 3 of the tube 2 of the dispensing apparatus 1, the front faces or labels of which can be viewed as they protrude forwardly through the display slot 4, as at 8', 9' and 10'. FIG. 2 shows the apparatus 1 in standard stacked and ready-for-dispensing configuration, operable with the aid of gravity in view of the vertical orientation.

The cans 8–10 with their upper and lower sealing lips, the lip 8'' of which is numbered in connection with the bottom-most can 8, have an exterior diameter surfficiently less than the diameter of the interior cavity 3 of the tube 2 to allow the cans 8–10 freely to slide along the longitudinally extending center axis of the tube, subject only to the forces of gravity. Although only three cans 8–10 are shown, further cans or other similarly shaped articles may be stored and dispensed in like manner. For a standard can, having an exterior height of 1-13/16 inches and an exterior diameter of 3-6/16 inches with its lip protrusions, an effective dispensing apparatus can be formed with the following dimensions: tube 2 interior diameter, $3\frac{1}{2}$ inches; tube 2 exterior diameter, $3\frac{3}{4}$ inches; tube 2 wall thickness, $\frac{1}{4}$ inch; arc length of display slot 4, 45°; arc length of dispensing slot, 70°; width of dispensing slot 5 at exterior edge, 3-5/16 inches; width of dispensing slot 5 at interior edge, 3-6/16 inches; height of dispensing slots, $3\frac{1}{8}$ inches; length of dowel 7, 2-15/16 inches—interior measure; distance from interior edge of tube 2 opposite slot 5 to center of dowel 7, 13/16 inches; distance from top of dispensing slot 5 to parallel level of dowel 7, 2 inches.

With the given dimensions, and in normal operation, the force of gravity, with the possible conjunction of the weight of upper cans 9–10, forces the lowermost can 8 into contact with the dowel 7, approximately half the distance between the rear edge of the can 8 and the center of gravity of the can 8, or approximately one quarter of the distance of the diameter of the can measured from the rear edge of the can 8 furthest from the slot 5. The can 8, being supported by the dowel 7 "off center", tips away from the dowel 7 at an angle $\phi$ (obtuse with respect to the vertical and acute with respect to the horizontal) and into contact with the side edges 6 of the dispensing slot 5. The resilient friction between the edges 6 and the upper lip 8'' of the can 8 and/or the slightly smaller slot cross dimension is sufficient to hold the can 8 in the tipped position, as shown in FIG. 2, until the can 8 is removed from the dispensing apparatus 1 as by grasping the can 8 and applying force to the can 8 substantially perpendicular to the center axis of the tube 2 and the dowel 7, resiliently to deform the slot edges 6 that contact the can 8 and exceed the friction and/or dimensional difference between the edges 6 and the upper lip 8'' of the can 8. Additionally, since the edges 6 of the slot 5 may be tapered or beveled, as discussed above, the edges 6 can contact the can 8 along the length of the bevel as opposed to only single paired points of contact if the edges 6 were not beveled. The increased surface area of contact provides for greater resistance to wear on the edges 6 as well as better frictional control of the can 8. Since the can 8 is tipped at angle $\phi$, a space is formed between the lowermost can 8 and the next higher can 9, and in conjunction with the space between the can 8 and the lower most portion of the dispensing slot 5, sufficient gaps are produced to enable easy grasping of the can 8, as by fingers (not shown) for removal of the can 8. When the can 8 has been removed, gravity forces the cans 9 and 10, etc. downward and the next can 9 is forced into a dispensing position similar to that of the previously described can 8.

The angle of tip $\phi$ is important, as the can 8 must be held within the interior 3 of the tube 2 while still supporting any cans stacked above it in the tube 2, such as cans 9 and 10, while being sufficient to provide upper and lower gaps for grasping the can 8 for removal, as discussed above. It has been found that an angle of up to about 15 degrees to the horizontal is acceptable.

With the present configuration, many cans or other objects can be stored in the dispensing apparatus 1, viewed through the display slot 4, and dispensed individually through the dispensing slot 5. Other objects, both cylindrical with circular cross-section (such as electrical fuses or the like) and non-circular cross-section articles (such as rectangular cans) can be dispensed with the present invention by suitably modifying the interior dimensions of the cylindrical tube 2 to allow interior movement along the center axis and appropriate position of the stop member to tip the object into contact with the edges 6 of the dispensing slot 5 at a sufficient angle to provide upper and lower gaps for grasping and removing the object.

The apparatus 1 may be mounted by any suitable racks, clamps or other devices (not shown) to provide a convenient storage and dispensing apparatus for similarly shaped objects. In the modification of FIG. 3, for example, the stop dowel 7 is mounted between lateral sides 11 of a rearwardly extending U-shaped mounting bracket secured to the tube and the rear wall 11' of which may be screwed or otherwise attached, as at 12, to a back wall or surface to assist in holding the dispenser 1' against the same (with another point of attachment near the top—not shown). In FIG. 3, the display slot 4' is not carried all the way down to the dispenser slot 5 to provide greater strength, and the lateral edges of the slot 5 are not beveled, as when thinner material tube walls are employed.

Further modifications will also occur to those skilled in this art, and such are considered to fall within the spirit and scope of the invention as defined in the appended claims.

What is claimed is:

1. Apparatus for dispensing cans and the like comprising a cylindrical tube having upper and lower portions and an interior diameter somewhat greater than the diameter of cans to be dispensed to allow movement of such cans along the center axis of the interior of the tube; a dispensing slot near the lower portion of the tube, said dispensing slot extending transverse to the center axis of the tube and being of sufficient dimension to allow a can to be removed therethrough from the tube; and stop means disposed within the interior of the tube opposite and rearward of the dispensing slot for contacting said can between its center of gravity and a rear edge thereof and for permitting said can to tilt forward into the dispensing slot and into engagement with edges of the slot.

2. Apparatus as claimed in claim 1 and in which at least a portion of the dispensing slot is constructed of resilient material and dimensioned such that when said can is contacted by the stop means, said can comes into resilient contact with said portion of the dispensing slot.

3. Apparatus as claimed in claim 1 and in which said edges of the dispensing slot extend parallel to the center axis of the tube and are beveled such that the length of arc of an outer portion of the slot is less than the length of the arc of an interior portion of the slot.

4. Apparatus as claimed in claim 1 and in which the tube has a further slot extending longitudinally parallel to the center axis of the tube for permitting viewing of portions of cans stacked within the tube.

5. Apparatus as claimed in claim 4 and in which the stop means is positioned such that downward force on said can through its enter of gravity, while said can is in contact with the stop means, will tip the can at an angle obtuse with respect to the center axis of the tube.

6. Apparatus as claimed in claim 5 and in which said can is tipped such that a top edge thereof approaches the lower portion of the tube.

7. Apparatus as claimed in claim 6 and in which said can is tipped at an angle up to about 15 degrees from perpendicular to the center axis of the tube.

8. Apparatus as claimed in claim 1 and in which the stop means contacts said can approximately half the distance between the center of gravity of the can and said rear edge of the can.

9. Apparatus as claimed in claim 1 and in which said edges of the dispensing slot are resilient and spaced transversely relative to the center axis of the tube so as to be capable of retaining said can within the dispensing slot and permitting resilient removal of the retained can therefrom.

10. Apparatus as claimed in claim 1 and in which the stop means is carried by the sides of a bracket extending rearwardly of the tube, away from the dispensing slot, and mountable upon a surface to support the tube near a lower end of the same.

* * * * *